US006748871B2

(12) United States Patent
Hellman

(10) Patent No.: US 6,748,871 B2
(45) Date of Patent: Jun. 15, 2004

(54) GUIDED ARTILLERY MISSILE WITH EXTREMELY LONG RANGE

(75) Inventor: Ulf Hellman, Ornskoldsvik (SE)

(73) Assignee: Bofors Defence AB, Karlskoga (SE)

( * ) Notice: Subject to any disclaimer, the term of this patent is extended or adjusted under 35 U.S.C. 154(b) by 0 days.

(21) Appl. No.: 10/344,726

(22) PCT Filed: Jun. 13, 2001

(86) PCT No.: PCT/SE01/01330

§ 371 (c)(1),
(2), (4) Date: Jul. 29, 2003

(87) PCT Pub. No.: WO02/14779

PCT Pub. Date: Feb. 21, 2002

(65) Prior Publication Data

US 2004/0021034 A1 Feb. 5, 2004

(30) Foreign Application Priority Data

Aug. 15, 2000 (SE) ..... 0002900

(51) Int. Cl.[7] ..... F42B 12/20
(52) U.S. Cl. ..... 102/490; 102/501; 244/3.27
(58) Field of Search ..... 102/490, 501, 102/473; 244/3.24, 3.27

(56) References Cited

U.S. PATENT DOCUMENTS 4,334,657 A * 6/1982 Mattson ..... 244/3.28
4,438,893 A 3/1984 Sands et al.
5,141,175 A 8/1992 Harris
6,135,387 A * 10/2000 Seidel et al. ..... 244/3.15
6,234,082 B1 5/2001 Cros et al.
6,336,609 B1 1/2002 Johnsson
6,588,700 B2 * 7/2003 Moore et al. ..... 244/3.28
2003/0146342 A1 * 8/2003 Hellman ..... 244/3.27

FOREIGN PATENT DOCUMENTS

| | | |
|---|---|---|
| DE | 4001914 | 3/1999 |
| EP | 0 811 822 A1 | 12/1997 |
| EP | 0 905 473 A1 | 3/1999 |
| WO | WO-98/43037 | 10/1998 |

* cited by examiner

*Primary Examiner*—J. Woodrow Eldred
(74) *Attorney, Agent, or Firm*—Connolly, Bove, Lodge & Hutz LLP

(57) ABSTRACT

The present invention relates to an artillery missile (1) intended for firing on a ballistic trajectory, with gliding characteristics which can be put into effect, after it has reached the summit of this trajectory, to increase the maximum range of the missile. In order to obtain these gliding characteristics, the missile is provided with extendable aerodynamic bearing surfaces divided into firstly canard fins (5–8), which are retracted in the front part of the missile body and can be extended after the summit of trajectory, secondly main bearing surfaces (9, 10) made of resilient material, which, likewise during launching, are curved in against and around the central part (3) of the missile body in shallow recesses adapted thereto in the outer casing of the missile and which, after the summit of trajectory and being extended, form the wings (9, 10) of the missile, and thirdly stem fins, which, durign at least launching, are covered i the retracted position by a protective cover (14) in the rear part (4) of the missile.

20 Claims, 3 Drawing Sheets

GUIDED ARTILLERY MISSILE WITH EXTREMELY LONG RANGE

Figure 1:
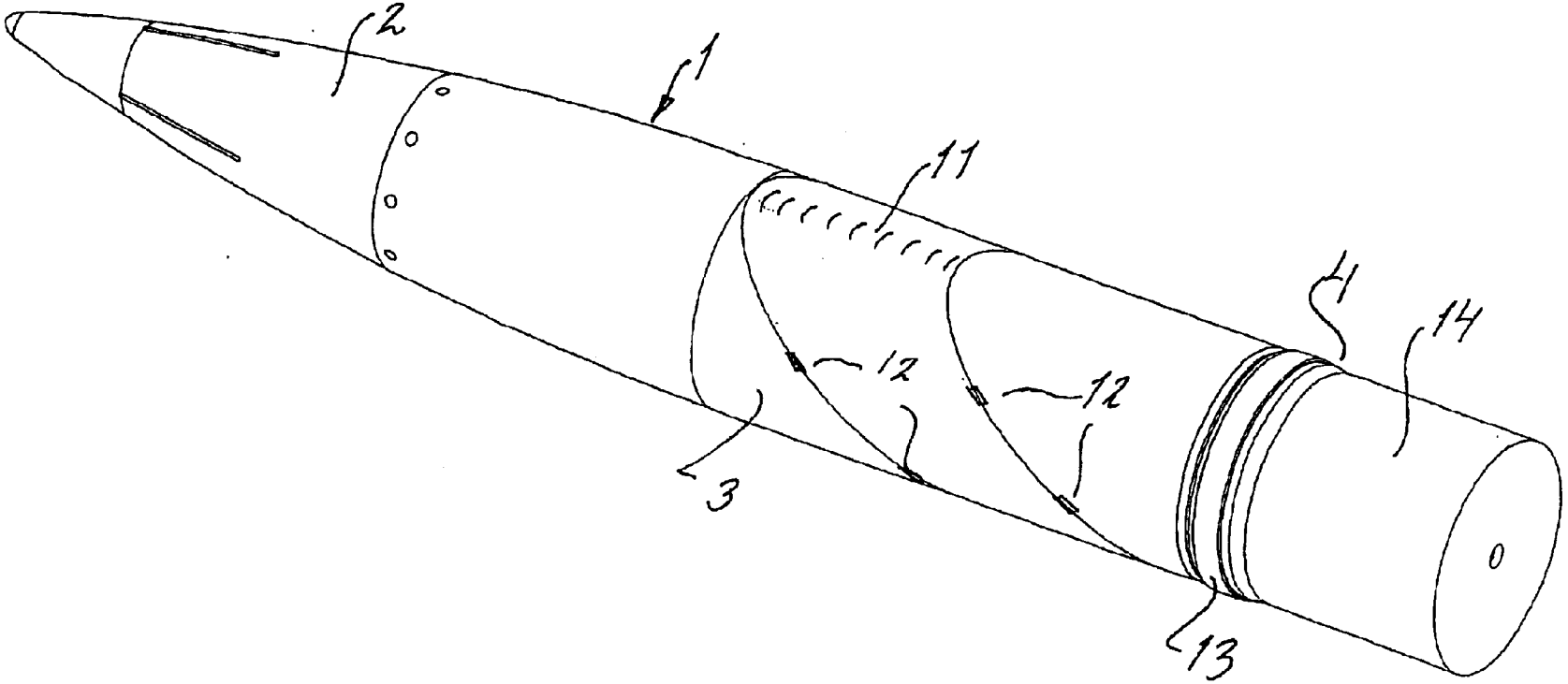

The present invention relates to an artillery missile which, for firing on a ballistic trajectory towards a predetermined target, can be fired from a barrel weapon, and which can be guided on the trajectory towards the target. It is particularly characteristic of the missile according to the invention that it has been imparted, over and above the maximum range with regard to its own launching speed, an extended range by means of good gliding characteristics which can be brought into play on the trajectory and are put into effect after or immediately before the missile reaches its summit of trajectory.

The present invention therefore means that we have succeeded in combining in one and the same artillery missile a number of characteristics which are apparently difficult to combine with one another, namely that the missile can in the first place be fired from a barrel weapon of conventional type and will in the second place have good gliding characteristics during the descending phase of its ballistic trajectory, which, considering the great dead weight of each artillery missile in relation to its volume, requires large ballistic bearing surfaces which must moreover be effectively retractable so as not to interfere during the launching phase, and that the missile will in the third place be guidable at least during the descending phase of the ballistic trajectory, that is to say during the gliding flight of the missile. For guiding the missile, use is made according to the invention of what are known as canard fins which are arranged in the front part of the missile and can be extended after launching.

However, the use of canard fins for guiding artillery missiles has already been proposed previously in U.S. Pat. No. 4,438,893. In the missile described therein, however, the canard fins are mounted in a freely rotating missile nose. The main function of this construction is to make possible rotational stabilization of the missile on its trajectory at the same time as the missile nose and the fins, owing to the lateral resistance of the fins to the surrounding atmosphere, remain stationary on the trajectory and, by virtue of being inclined relative to the longitudinal axis of the missile, can influence the missile trajectory. It is therefore not lengthening the trajectory by gliding flight but only correction of the original ballistic trajectory of the missile which is involved in this context.

From DE-40 01 914, it is also known to produce launchable bodies which are airborne after launching and are provided with special bearing surfaces which are curved in towards the body in question during the launching phase and can be folded out or extended after launching. However, the type of bearing surface described there appears to be intended principally for sub-warheads to which it is desirable to impart a curved trajectory, because the bearing surfaces have been arranged in a zigzag shape one after another as far as those which form the right/left wing are concerned, and this design automatically produces a curved trajectory owing to the imbalance thus built in. The zigzag-shaped wing positioning moreover affords greater possibilities with regard to varying the shape of the wings, because they will then never collide in their retracted positions curved in towards the fuselage.

Finally, W098/43037 can be mentioned as an example of a stern-fin assembly for artillery missiles comprising a number of extendable fins which are covered during the launching phase by a protective cover and are extended as soon as this protective cover has been removed, but here, as in most other cases, it is a matter of a fin-stabilized shell without any form of advanced gliding characteristics.

As already indicated, the present invention can be considered to consist of an artillery missile which is launched in a conventional manner on a ballistic trajectory from a barrel weapon and which, during the launching phase, has the customary outer shape of an artillery shell, but which, after it has passed or in connection with it passing the summit of its ballistic trajectory, extends from its own front part controllable canard fins and folds out or extends at the level of the central part of the missile body fixed main bearing surfaces which, during the launching phase, were curved in against and pressed down in shallow recesses adapted thereto in the outer casing of the missile body, at the same time as stern fins adapted thereto then or previously are extended in the rear part of the missile. The canard fins are then used for guiding the missile on its descending trajectory part at the same time as it has been possible, by virtue of the inclusion of the main bearing surfaces or wings and the stern fins, to combine this possibility of correcting the trajectory of the missile with the fact that it has been possible to impart good gliding characteristics and thus a considerably extended range to the missile during the same trajectory part. The design included in the invention of the extendable main bearing surfaces has been made possible by virtue of the fact that these are made from a resilient material which allows the curving-in which is necessary in order that the main bearing surfaces will be capable of being forced into close contact with the missile body down in the shallow recesses intended therefor and of being locked in this position until the missile is approaching or has just passed the summit of its ballistic trajectory. The material selected for the main bearing surfaces must moreover have such a good inherent shape memory that, after being extended, they adopt the position and any wing profile selected Previously in order to impart the desired gliding characteristics to the missile as a whole. At the same time, the material must have sufficient inherent rigidity in order to be capable of bearing the load which the missile body involves. A main bearing surface or wing of this type can be given the desired wing profile either by means of a bellied plate which is pressed flat in its retracted position or two bellied plates which are welded together with one another along their respective longitudinal edges and are likewise pressed flat in the retracted positions of the bearing surfaces. Materials suitable for this purpose may consist of titanium or titanium alloys.

As far as the stern fins are concerned, these can be designed in a number of different previously known ways and they can be extended at the same time as other bearing surfaces or at a considerably earlier time, for example immediately after the missile leaves the barrel. In the latter case, use is then made of the stern fins for fin-stabilizing the missile already during its ascending trajectory.

Figure 2:
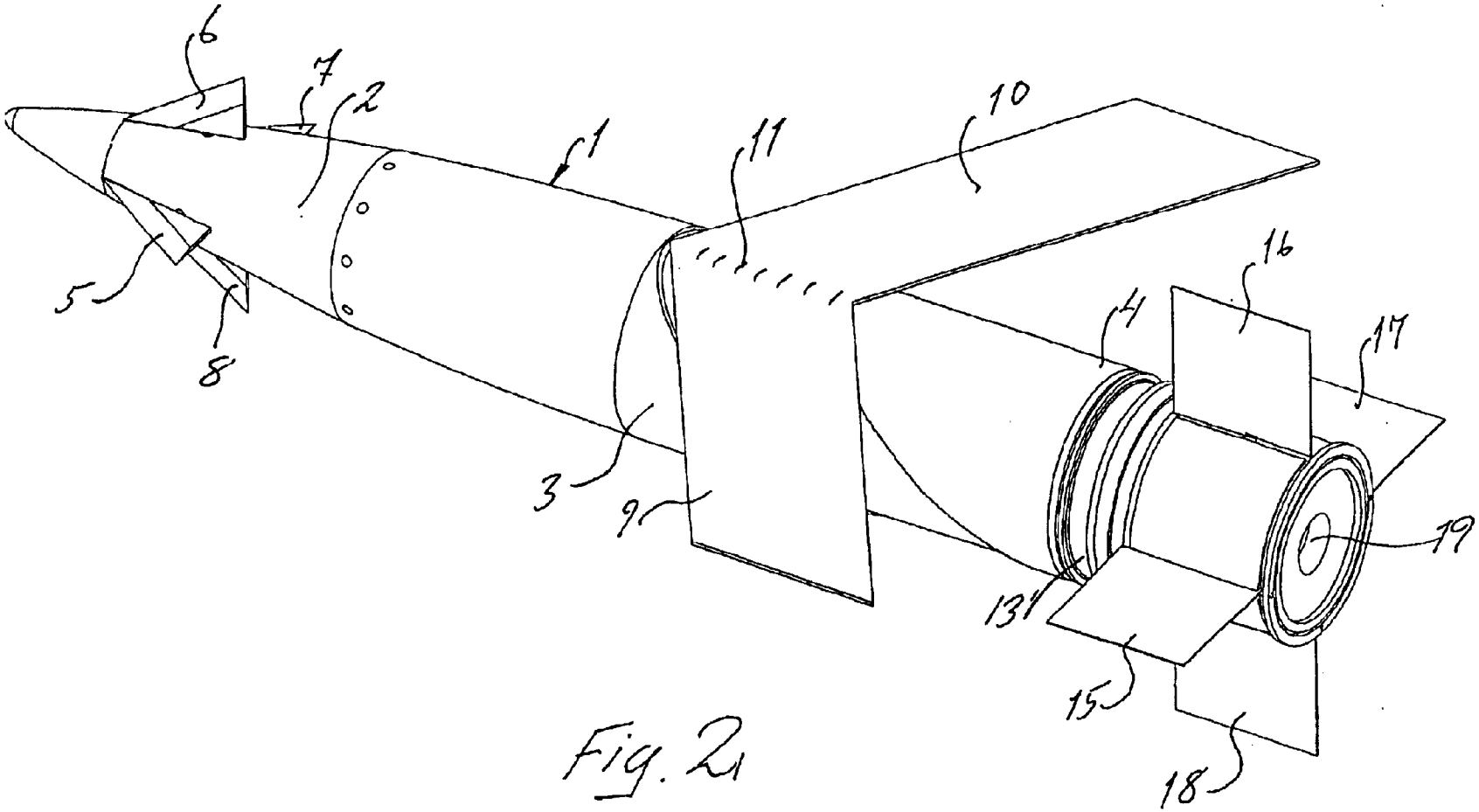
Figure 3:
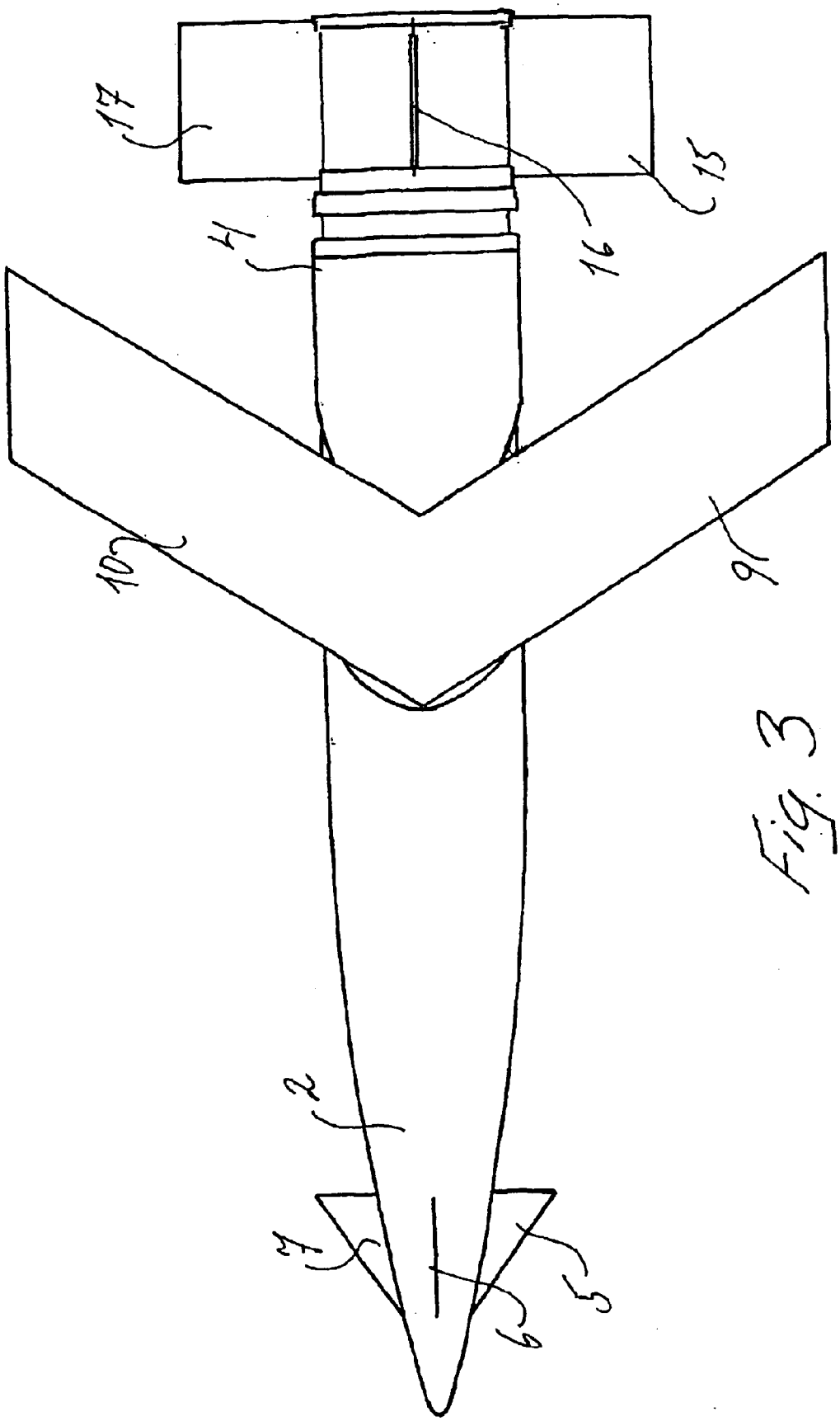

The invention has been defined in the patent claims below and it will now be described in somewhat greater detail in connection with the accompanying figures, in which FIG. 1 shows a projection at an angle of a missile according to the invention in the form it has before and during launching, FIG. 2 shows a projection at an angle of the missile according to FIG. 1 in the form it has after it has passed the summit of its ballistic trajectory, and FIG. 3 shows the same missile in the same form as in FIG. 2 but here in a plan view and on somewhat smaller scale.

The missile according to the invention comprises a missile body 1 with a front part 2, a central part 3 and a stern part 4. In the front part 2 of the missile body, there are spaces for four canard fins 5–8 which are retracted in the view shown in FIG. 1 and extended in the other figures and can be controlled in their extended positions, and by means of which the trajectory of the missile can be corrected in its descending part. In the central part 3 of the missile body, the main bearing surfaces 9 and 10 of the missile are mounted along a central mounting region 11 extending in the longitudinal direction of the missile. In the extended position, the main bearing surfaces form two substantially plane wings 9 and 10 mounted on the upper side of the missile at 11. The missile is therefore high-winged. In the retracted position, that is to say before launching, during launching and up to at least close to the summit of trajectory, the main bearing surfaces are kept folded in and pressed closely against the bottom of shallow recesses intended therefor in the outer casing of the missile. The main bearing surfaces are retained in this position by a number of special mechanical locking means which lie entirely within the smooth outer shape of the missile and are designed so as to release their grip simultaneously, and some of which are indicated in FIG. 1 by reference number 12. Rapid, automatic transition from their retracted position to their correct extended position is ensured by intrinsic properties of the material of the main bearing surfaces. These material properties can also ensure that the main bearing surfaces adopt a desired wing profile.

In the rear part 4 of the missile, there is the driving belt 13 obligatory for launching from a barrel weapon and, behind this, a cover 14 which covers four initially retracted stern fins 15–18 during the launching phase. These fins are kept in the retracted position by the cover and are extended as soon as this has been removed. The cover 14 can also be removed immediately after the missile has left the barrel from which it was fired, and the missile can then be held fin-stabilized during the ascending portion of the ballistic trajectory. The canard fins and main bearing surfaces can then be extended in the manner described previously and at the time indicated previously, and it is only when all the bearing surfaces (the canard fins, the main bearing surfaces and the stern fins) are extended that the guided gliding flight of the missile towards an extended range can begin. In the example shown in the figures, a base-bleed unit 19 for an additionally extended range is also indicated. The base-bleed unit 19 constitutes conventional art, however, and will therefore not be described in greater detail in this context.

In FIGS. 2 and 3, the driving belt 13 is missing as it is of the slipping type and has already left the missile. The figures therefore show only the driving belt groove 13'.

What is claimed is:

1. Artillery missiles (1) intended for firing on a ballistic trajectory, with gliding characteristics which can be put into effect, after it has reached the summit of this trajectory, to increase the maximum range of the missile and which are based on aerodynamic bearing surfaces which initially, during the first phase of the flight of the missile towards the target including launching and the rising part of the ballistic trajectory, are retracted within the aerodynamic outer shape of the missile (1), which is adapted to conditions applying then, and which bearing surface can be extended after the summit of trajectory, characterized in that these bearing surfaces are divide into firstly canard fins (5–8), which are retracted in the front part of the missile body during said first phase of the flight of the missile (1) towards the target and can be extended after the summit of trajectory, secondly main bearing surfaces (9, 10) each of resistance material, which, during said first phase, are curved in against and around the central part (3) of the missile body in shallow recesses adapted thereto in the outer casing of the missile and which, after the summit of trajectory are being extended, form the wings (9, 10) of the missile, and thirdly rear fins (15–18), which, during at least the launching phase, are surrounded in the retracted position by a protective cover (14) in the rear part (4) of the missile and, after removal of the protective cover, can be extended.

2. Artillery missile according to claim 1, characterized in that, in the extended position, the main bearing surface (9, 10) form two bearing wings which, in spite of the fact that, during said first phase, they were curved in against and down in recesses intended therefor in the missile body and locked in these recesses by locking means (19) designed for the purpose, and by virtuo of the test that are made from a resintent material with good shape memory, constitute in this extended position bearing wings which are substantially straight in the horizontal plane and are mounted on the part (11) of the shell facing upward in its gliding position.

3. Artillery missile according to claim 1, characterized in that main bearing surfaces or wings (9, 10) have been given a wing profile which is built into the shape memory of the material and is realized after they have been extended.

4. Artillery missile according to claim 3, characterized in that the individual main bearing surface consist of two plate designed with built-in memory bellying which are interconnected along their respective longitudinal edges and, in the retracted position of the bearing surface (9, 10), can be forced in against one another into vertical plane contact with one another and down in the recesses adapted thereto of the missile body (1), is which position they are retained by locking means (12) designed for the purpose until the missile approaches or has just passed the summit of trajectory.

5. Artillery missile according to claim 1, characterized in that it comprises what is known as a base-blend unit (19) arranged in its part.

6. Artillery missile according to claim 1, characterized in that its main bearing surfaces (9, 10) are of such a length that, in their retracted position, they met on the opposite side of the missile (1) to the mounting of the bearing surface on the missile body.

7. Artillery missile according to claim 1, characterized in that, in the extended position, the main bearing surface (9, 10) have an arrow wing shape or a delta shape with a swept-back substantially straight front edge.

8. Artillery missile according to claim 2, characterized in that its main bearing surfaces or wings (9, 10) have been given a wing profile which is built into the shape memory of the material and is realized after they have been extended.

9. Artillery missile according to claim 2, characterized in that it comprises what is known as a base-bleed unit (19) arranged in its rear part.

10. Artillery missile according to claim 3, characterized in that it comprises what is known as a base-bleed unit (19) arranged in its rear part.

11. Artillery missile according to claim 4, characterized in that it comprises what is known as a base-bleed unit (19) arranged in its rear part.

12. Artillery missile according to claim 2, characterized in that its main bearing surface (9, 10) are of such a length that, in their retracted position, they met on the opposite side of the missile (1) to the mounting of the bearing surface on the missile body.

13. Artillery missile according to claim 3, characterized in that its main bearing surface (9, 10) are of such a length that, in their retracted position, they met on the opposite side of the missile (1) to the mounting of the bearing surface on the missile body.

14. Artillery missile according to claim 4, characterized in that its main bearing surface (9, 10) are of such a length that, in their retracted position, they met on the opposite side of the missile (1) to the mounting of the bearing surface on the missile body.

15. Artillery missile according to claim 5, characterized in that its main bearing surface (9, 10) are of such a length that, in their retracted position, they met on the opposite side of the missile (1) to the mounting of the bearing surface on the missile body.

16. Artillery missile according to claim 2, characterized in that, in the extended position, the main bearing surfaces (9, 10) have a arrow wing shape or a delta shape with a swept-back substantially straight front edge.

17. Artillery missile according to claim 3, characterized in that, in the extended position, the main bearing surfaces (9, 10) have an arrow wing shape or a delta shape with swept-back substantially straight front edge.

18. Artillery missile according claim 4, characterized in that, in the extended position, the main bearing surfaces (9, 10) have an arrow wing shape or delta shape with a swept-back substantially front edge.

19. Artillery missile according to claim 5, characterized in that, in the extended position, the main bearing surfaces (9, 10) have an arrow wing shape or a delta shape with a swept-back substantially front edge.

20. Artillery missile according to claim 6, characterized in that, in the extended position, the main bearing surface (9, 10) have an arrow shape or a delta shape with a swept-back substantially front edge.

* * * * *